US009189987B2

(12) United States Patent
Chiang

(10) Patent No.: US 9,189,987 B2
(45) Date of Patent: Nov. 17, 2015

(54) METHOD FOR GENERATING DITHER CARRY TABLES BY CONVERSION PROCEDURE

(71) Applicant: HIMAX TECHNOLOGIES LIMITED, Tainan (TW)

(72) Inventor: Chi-Cheng Chiang, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 332 days.

(21) Appl. No.: 13/745,308

(22) Filed: Jan. 18, 2013

(65) Prior Publication Data

US 2014/0204113 A1 Jul. 24, 2014

(51) Int. Cl.
*G09G 5/02* (2006.01)
*G09G 3/20* (2006.01)

(52) U.S. Cl.
CPC ..... *G09G 3/2051* (2013.01); *G09G 2340/0428* (2013.01)

(58) Field of Classification Search
CPC ..... G09G 5/02; G09G 3/2044; G09G 3/2003
USPC ..... 345/596, 597, 599
See application file for complete search history.

(56) References Cited

U.S. PATENT DOCUMENTS

2011/0012918 A1* 1/2011 Lee et al. ..... 345/596
2012/0154428 A1* 6/2012 Barnhoefer ..... 345/596

FOREIGN PATENT DOCUMENTS

TW 201234868 8/2012

OTHER PUBLICATIONS

"Office Action of Taiwan Counterpart Application", issued on Nov. 20, 2014, p. 1-p. 4.

* cited by examiner

*Primary Examiner* — Ming Hon
*Assistant Examiner* — Shivang Patel
(74) *Attorney, Agent, or Firm* — J.C. Patents

(57) ABSTRACT

A carry table generating method is provided for generating N dither carry tables, so as to dither N pixel blocks, wherein a size of the pixel block is N×N, and N is an integer greater than 1. The carry table generating method comprises the following steps: reading a plurality of basic tables from a memory, wherein the base tables are corresponding to a plurality of basic blocks, the number of the basic blocks is smaller than N, and the size of the basic blocks is smaller than the size of the pixel blocks; expanding the size of the basic tables by a first conversion procedure, and expanding the number of the basic blocks by a second conversion procedure; and generating the dither carry tables by using the expanded basic blocks.

9 Claims, 6 Drawing Sheets

METHOD FOR GENERATING DITHER CARRY TABLES BY CONVERSION PROCEDURE

BACKGROUND OF THE INVENTION

1. Field of the Invention

This invention is related to a carry table generating method, and more particularly to a method of generating a carry table suitable for being applied to a dithering process.

2. Description of Related Art

A frequently encountered problem in displaying a digital image is that the gray level resolution of a display device is smaller than that of an original image. Therefore, the data width used by the internal operation of the display device is usually greater than the data width used by the input/output ports thereof. Under such conditions, the display device has to use dithering process in order to decrease the data width of its outputted pixel gray value.

Dithering is to utilize the property that human eyes automatically do average calculations on gray values of small regions when viewing from a long distance, so as to make a display screen show more color gradations. In addition, a common dithering process is to remove the lower bits in a pixel gray value, for example, the least significant bit (LSB), and then to determine if the pixel gray value should plus one according to a dither carry table.

For example, the lower 4 bits in a pixel gray value may be rounded off in a dithering process. In addition, to compensate for the rounded-off 4 bits, the dithering process has to make the display screen display 1/16 gray level. Therefore, such a dithering process has to record each single color by using 16 dither carry tables with a size of 16×16. In addition, a conventional carry table generating method is to directly read 16 dither carry tables with a size of 16×16 from a memory. In other words, a memory of 16×16×16 bits, i.e. 512 bytes, is required for storing 16 dither carry tables. As a result, however, huge memory space will be consumed for generating the required dither carry tables.

SUMMARY OF THE INVENTION

The present invention provides a carry table generating method, which, on the basis of a plurality of basic tables and their corresponding basic blocks, expands the size and number of the basic blocks by different conversion procedures, and further generates dither carry tables by using the expanded basic blocks.

The present invention provides a carry table generating method, which is used to generate N dither carry tables, so as to dither N pixel blocks, wherein a size of the pixel block is N×N, and N is an integer greater than 1. The carry table generating method comprises: reading a plurality of basic tables from a memory, wherein the base tables are corresponding to a plurality of basic blocks, the number of the basic blocks is smaller than N, and the size of the basic blocks is smaller than the size of the pixel blocks; expanding the size of the basic tables by a first conversion procedure in a timing controller, and expanding the number of the basic blocks by a second conversion procedure in the timing controller; and generating the dither carry tables by using the expanded basic blocks through the timing controller. Besides, the step of expanding the size of the basic tables by the first conversion procedure comprises: in the first conversion procedure, expanding the size of the basic blocks by using a combination among the basic blocks or a combination among the basic blocks and a plurality of first extended blocks. Furthermore, the step of expanding the number of the basic blocks by the second conversion procedure comprises: in the second conversion procedure, re-arranging sub-blocks in the basic blocks to form a plurality of second extended blocks; and, expanding the number of the basic blocks by using the second extended blocks.

In an embodiment of the present invention, the carry table generating method further comprises: determining if the sizes of the basic blocks and the pixel blocks are the same; determining if the number of the basic blocks is equal to N, when the sizes of the basic blocks and the pixel blocks are the same; expanding the size of the basic blocks by the first conversion procedure and returning to the step of determining if the number of the basic blocks is equal to N, when the sizes of the basic blocks and the pixel blocks are not the same; expanding the number of the basic blocks by the second conversion procedure and simultaneously determining the size and number of the basic blocks, when the number of the basic blocks is not equal to N; returning to the step of determining if the sizes of the basic blocks and the pixel blocks are the same, when a result of the step of simultaneously determining the size and number of the basic blocks shows that the sizes of the basic blocks and the pixel blocks are not the same or the number of the basic blocks is not equal to N; and generating the dither carry tables by using the expanded basic blocks, when a result of the step of simultaneously determining the size and number of the basic blocks shows that the sizes of the basic blocks and the pixel blocks are the same and the number of the basic blocks is equal to N.

In an embodiment of the present invention, the carry table generating method further comprises: determining if the sizes of the basic blocks and the pixel blocks are the same; expanding the size of the basic blocks by the first conversion procedure and returning to the step of determining if the sizes of the basic blocks and the pixel blocks are the same, when the sizes of the basic blocks and the pixel blocks are not the same; determining if the number of the basic blocks is equal to N, when the sizes of the basic blocks and the pixel blocks are the same; expanding the number of the basic blocks by the second conversion procedure and returning to the step of determining if the number of the basic blocks is equal to N, when the number of the basic blocks is not equal to N; and generating the dither carry tables by using the expanded basic blocks, when the number of the basic blocks is equal to N.

According to the above, the carry table generating method provided by the present invention, on the basis of a plurality of basic tables stored in a memory and their corresponding basic blocks, generates a plurality of corresponding dither carry tables by expanding the size and number of the basic blocks. Accordingly, memory consumption may be reduced significantly, and production cost may further be decreased.

In order to make the aforementioned features and advantages of the present invention more comprehensible, embodiments accompanied with figures are described in detail below.

DETAILED DESCRIPTION OF DISCLOSED EMBODIMENTS

In order to make the present invention more comprehensible, embodiments are described below as the examples to prove that the present invention can actually be realized. In addition, wherever possible, identical or similar reference numbers stand for identical or similar elements in the figures and the embodiments.

In the carry table generating method disclosed by the embodiments of the present invention, when a display device dithering an image, dither carry tables required for the dithering process may be generated by a plurality of basic tables, and further, the memory space required therefor may be reduced. In addition, the carry table generating method disclosed by the embodiments of the present invention is used to generate N dither carry tables with a size of N×N, so as to be applied to a dithering process capable of displaying 1/N gray level dithering, wherein N is an integer greater than 1. For example, when the lower 4 bits in a pixel gray value are rounded off in a dithering process, a 1/16 dithering process has to be performed on a display screen, i.e. N=16. In addition, the display screen will be divided into 16 pixel blocks, and the size of each pixel block is 16×16. In order to dither 16 pixel blocks with a size of 16×16, 16 dither carry tables with a size of 16×16 have to be generated correspondingly. In other words, each dither carry table is corresponding to each pixel block, and each dither carry table records the carry information of each corresponding pixel block.

Figure 1:
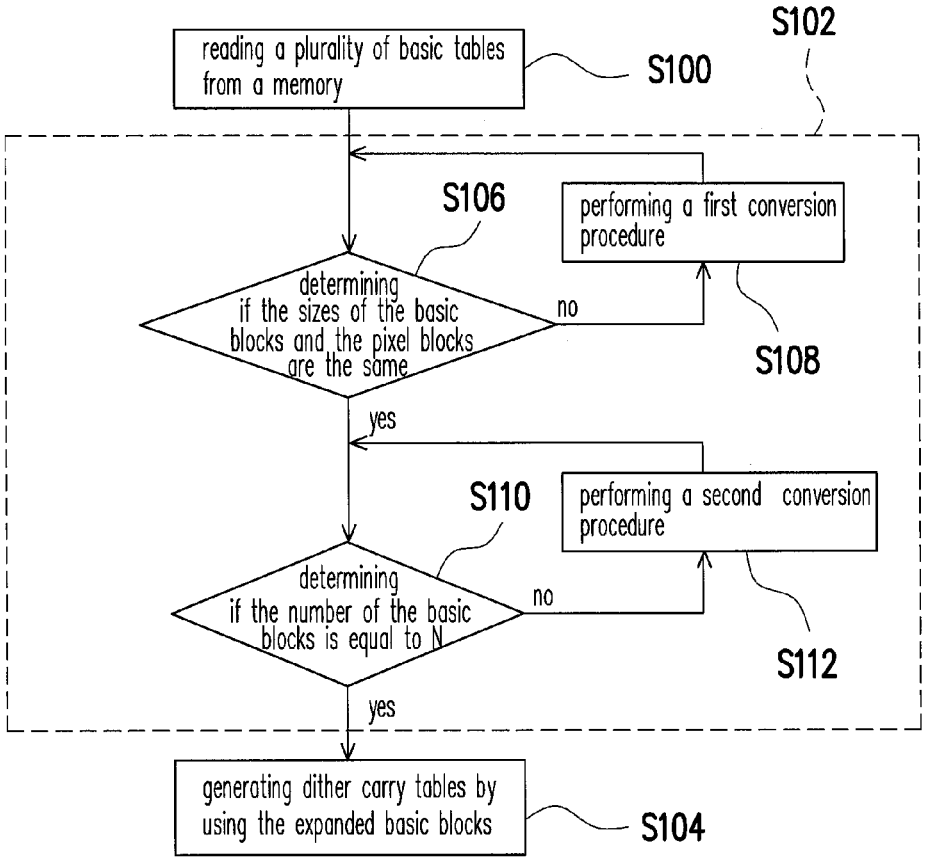
FIG. 1 is a flowchart of a carry table generating method according to an embodiment of the present invention.
Figure 2:
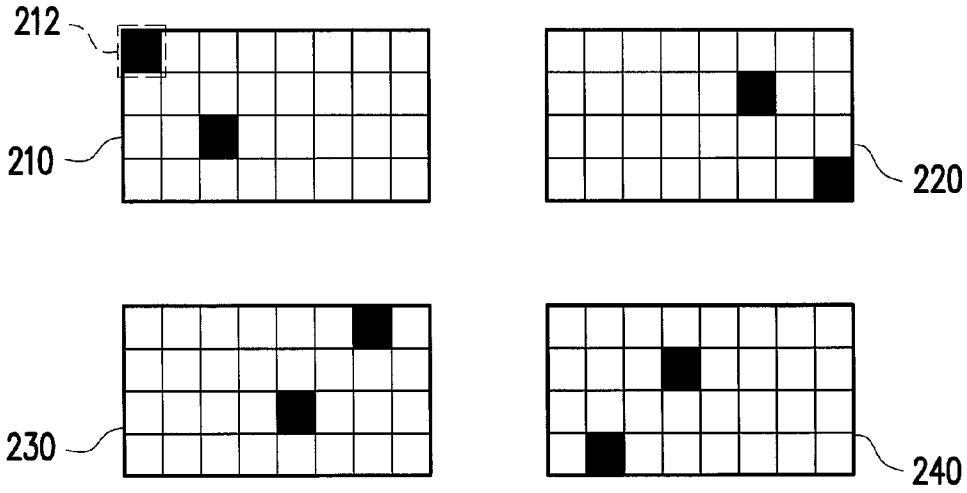
FIG. 2 is a schematic drawing of basic blocks according to an embodiment of the present invention.

For more clarification of the embodiments of the present invention, FIG. 1 is a flowchart of a carry table generating method according to an embodiment of the present invention. FIG. 2 is a schematic drawing of basic blocks according to an embodiment of the present invention. Here, a dithering process capable of displaying 1/16 (N=16) is described hereinafter as an example to illustrate the generation of a carry table. Referring to both FIG. 1 and FIG. 2, firstly, as shown in step S100, the basic tables in the memory are read, wherein each basic table is corresponding to a basic block, and each value in the basic tables is corresponding to a sub-block in the basic blocks.

In this embodiment, the memory is preset to store 4 basic tables, respectively corresponding to the basic blocks 210, 220, 230, and 240. In the example of the basic block 210, Table 1 displays a basic table which is corresponding to the basic block 210, wherein the size of the basic block 210 is 4×8, i.e. the basic block 210 comprises 4×8 sub-blocks. In addition, the basic table comprises 4 data rows, each data row recording 8-bit carry data. Accordingly, 4 carry data with 8-bit may be used for recording 4×8 sub-blocks in the basic block 210. In addition, a bit value of 1 in a carry data indicates that the color of the corresponding sub-block is black; otherwise, a bit value of 0 indicates that the color of the corresponding sub-block is white. For example, the most significant bit in the first carry data has a bit value of 1, and is corresponding to the sub-block 212 in the basic block 210.

TABLE 1

| Value | | | | | | | |
|---|---|---|---|---|---|---|---|
| 1 | 0 | 0 | 0 | 0 | 0 | 0 | 0 |
| 0 | 0 | 0 | 0 | 0 | 0 | 0 | 0 |

TABLE 1-continued

| Value | | | | | | | |
|---|---|---|---|---|---|---|---|
| 0 | 0 | 1 | 0 | 0 | 0 | 0 | 0 |
| 0 | 0 | 0 | 0 | 0 | 0 | 0 | 0 |

It is to be noted here that the selection of number and size of basic table may vary depending on the needs of the designer. As long as the requirements are met that the number of the basic blocks is smaller than 16 and the size of the basic blocks is smaller than 16×16, it is possible to use the method provided by the present invention to generate the required 16 dither carry tables with a size of 16×16 by using less memory. The present invention is not limited thereto.

Next, as shown in step S102, the first conversion procedure in a timing controller of the display device is used to expand the size of the basic blocks, and the second conversion procedure in the timing controller of the display device is used to expand the number of the basic blocks. Moreover, after step S102 is completed, the expanded basic blocks are used to generate the dither carry tables (step S104).

Figure 3A:
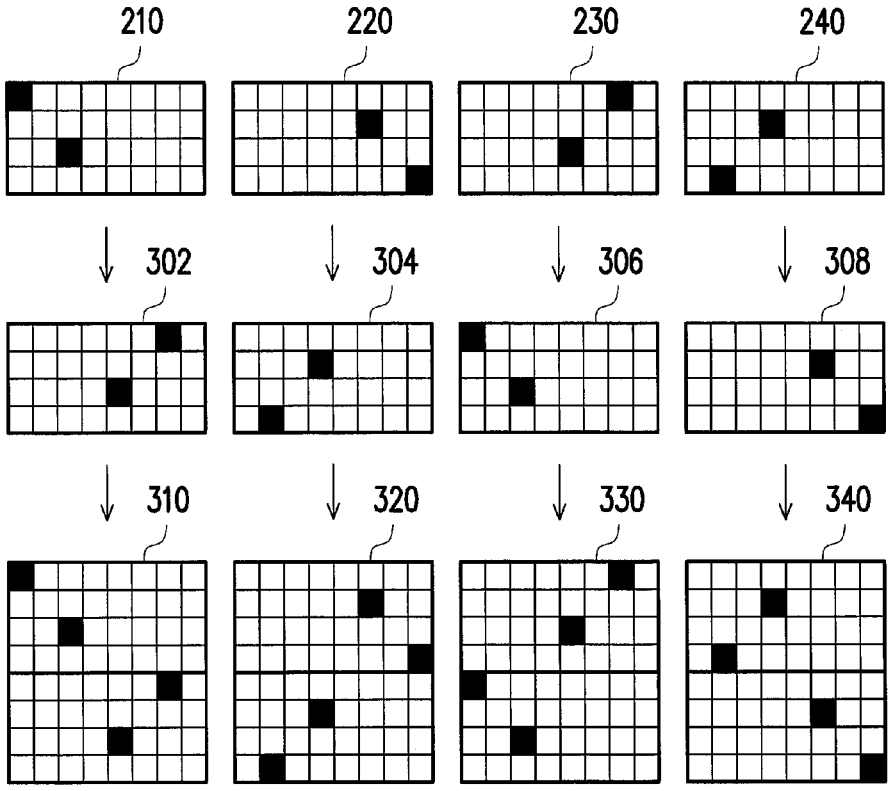
FIGS. 3A to 3C are respectively schematic drawings to illustrate an expansion of basic blocks according to an embodiment of the present invention.
Figure 3B:
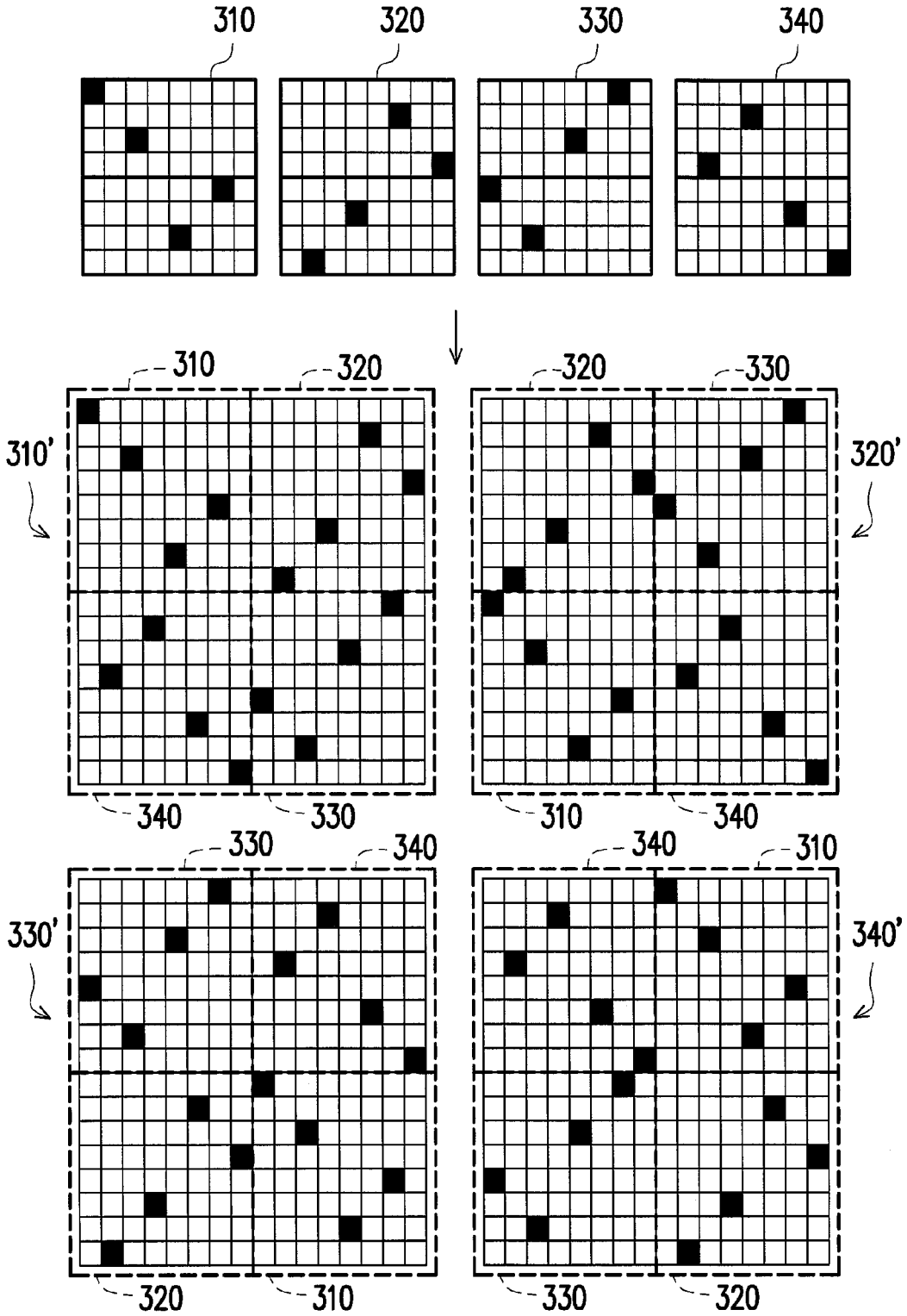
Figure 3C:
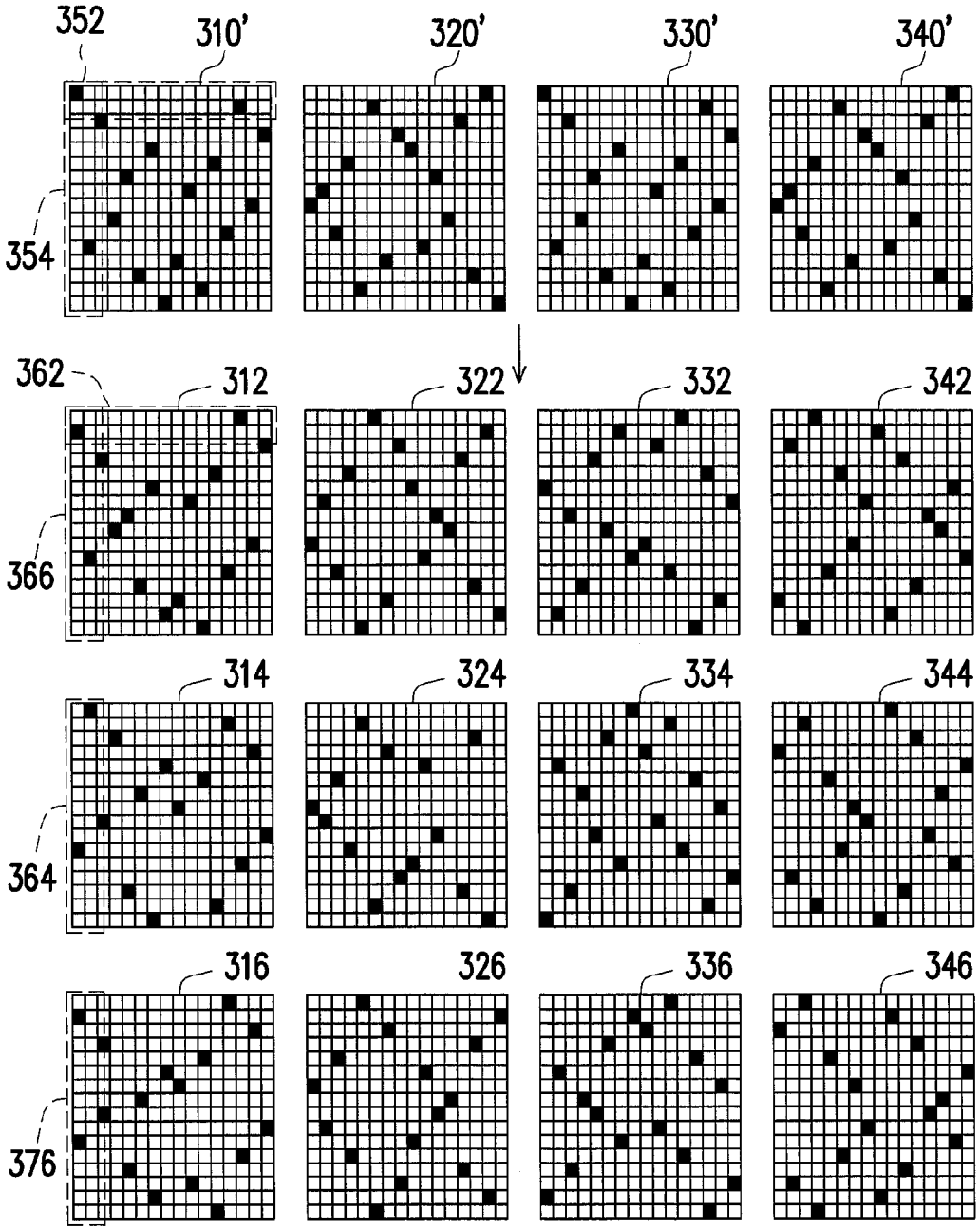

FIGS. 3A to 3C are respectively schematic drawings to illustrate an expansion of basic blocks according to an embodiment of the present invention. Referring to FIG. 1 and FIGS. 3A-3C, a more detailed explanation of the carry table generating method is provided hereinafter.

In terms of the details of the flow of step S102, as shown in step S106, it will be further determined if the size of the basic blocks 210-240 is 16×16. Here, since the preset size of the basic blocks 210-240 is 4×8, the first conversion procedure in the timing controller will be performed to expand the size of the basic blocks 210-240, as shown in step S108.

In the operation of expanding the size of the basic blocks 210-240, the sub-blocks in the basic blocks 210, 220, 230 and 240 will be re-arranged, so as to form a plurality of first extended blocks, and the first extended blocks will be combined with the basic blocks 210, 220, 230 and 240, so as to expand the size of the basic blocks 210, 220, 230 and 240. For example, as shown in FIG. 3A, each sub-block in the basic blocks 210, 220, 230 and 240 will be vertically shifted according to a first shifting quantity; also, each sub-block in the basic blocks 210, 220, 230 and 240 will be horizontally shifted according to a second shifting quantity. Accordingly, the sub-blocks in the basic blocks 210, 220, 230 and 240 will be re-arranged, so as to form the first extended blocks 302, 304, 306 and 308.

In real application, the designer may control the first shifting quantity of vertical shift and the second shifting quantity of horizontal shift by respectively using a first set value and a second set value stored in a memory, according to the polarity of a display panel. As shown in Table 2, the first set value and the second set value are each represented by a binary value, i.e. the first shifting quantity is 2, and the second shifting quantity is 4. Accordingly, each sub-block in the basic blocks 210, 220, 230 and 240 will be shifted vertically downward by 2 units according to the first set value, and will be shifted horizontally rightward by 4 units according to the second set value, so as to form the first extended blocks 302, 304, 306 and 308. It is to be noted here that vertically downward shift and horizontally rightward shift are only one of the ways of implementation in this embodiment, and the sub-blocks may also be shifted vertically upward, or horizontally leftward, or in other specific directions. The present invention is not limited thereto.

TABLE 2

| | |
|---|---|
| First Set Value | 10 |
| Second Set Value | 100 |

Next, the basic blocks 210, 220, 230, 240 and the first extended blocks 302, 304, 306, 308 will be combined with one another, so as to obtain the basic blocks 310, 320, 330 and 340, with a size of 8×8.

After expanding the size of the basic blocks 210-240 by the first conversion procedure, the process will go back to step S106 so as to re-determine if the size of the basic blocks 310, 320, 330 and 340 is 16×16. Here, since the size of the basic blocks is 8×8, the process will go back to step S108 to perform again the first conversion procedure in the timing controller. In the first conversion procedure at this stage, it is possible to selectively combine the basic blocks 310, 320, 330 and 340 with one another, so as to expand the size of the basic blocks 310, 320, 330 and 340.

For example, as shown in FIG. 3B, the basic blocks 310, 320, 330 and 340, with a size of 8×8, may be expanded into the basic blocks 310', 320', 330' and 340', with a size of 16×16, by combinations between themselves. Specifically, starting with the basic block 310 and proceeding in a clockwise direction, the basic blocks 310, 320, 330 and 340 may be arranged and combined in sequence, such that the basic block 310 with a size of 8×8 is expanded into the basic block 310' with a size of 16×16. Similarly, starting with the basic block 320 and proceeding in a clockwise direction, the basic blocks 320, 330, 340 and 310 may be arranged and combined in sequence, so as to expand the basic block 320 with a size of 8×8 into the basic block 320' with a size of 16×16. In the same way, the basic blocks 330' and 340' with a size of 16×16 are generated.

From another point of view, the basic block 310' is formed by combining the basic blocks 310, 320, 330 and 340 in sequence, wherein the basic blocks 310, 320, 330 and 340 are arranged top-left, top-right, bottom-right and bottom-left. In addition, the basic blocks 320', 330' and 340' may further be formed from the basic block 310' with a size of 16×16. For example, according to the arrangement manner of the basic block 310', it is possible to re-arrange the basic blocks 310, 320, 330 and 340 in a counter-clockwise direction, such that the basic blocks 310, 320, 330 and 340 are combined to form the basic block 320', wherein the basic blocks 310, 320, 330 and 340 are arranged bottom-left, top-left, top-right and bottom-right. In the same way, the basic blocks 330' and 340' are generated.

It is worth noting that the combination method disclosed in the embodiment of FIG. 3B is only one of the ways of implementation in this embodiment. In real application, combination may also be performed in a counter-clockwise direction, which depends on the design of persons of ordinary skill in the art. The present invention is not limited thereto. In addition, with respect to the first conversion procedure disclosed in FIG. 3A and FIG. 3B, in this embodiment a basic block with a size of 4×8 is expanded into a basic block with a size of 8×8 by combination between first extended blocks and basic blocks, and then the basic block with a size of 8×8 is expanded into a basic block with a size of 16×16 by combinations between basic blocks; however, this is not intended to limit the present invention.

In another embodiment, a basic block with a size of 4×8 may be expanded into a basic block with a size of 8×16 by combination between the basic blocks 210-240, and then the basic block with a size of 8×16 is expanded into a basic block with a size of 16×16 by combination between the first extended blocks and the basic blocks. In addition, all of the other algorithms for expanding the size of basic blocks are included in the first conversion procedure. The designer may change the way of expanding the size of basic blocks based on their design needs, and thus the present invention is not limited thereto.

Still referring to FIG. 1, after the first conversion procedure in step S108 is completed, the process will go back to step S106. Here, since the sizes of the basic blocks 310', 320', 330' and 340' are each equal to the size of the pixel blocks, step S110 will be performed, so as to determine if the number of the basic blocks 310', 320', 330' and 340' is equal to 16. Here, since the number of the basic blocks 310', 320', 330' and 340' is 4, as shown in step S112, the second conversion procedure in the timing controller will be performed to expand the number of the basic blocks.

As shown in FIG. 3C, in the second conversion procedure, the sub-blocks in the basic blocks 310', 320', 330' and 340' are re-arranged, so as to form the second extended blocks 312, 314, 316, 322, 324, 326, 332, 334, 336, 342, 344 and 346; the second extended blocks 312, 314, 316, 322, 324, 326, 332, 334, 336, 342, 344 and 346 are further set as the basic blocks, so as to expand the number of the basic blocks.

For example, in the second conversion procedure, a plurality of different rotating operations may be used in sequence to move the sub-blocks in the basic blocks 310', 320', 330' and 340', so as to form the second extended blocks. During the rotating operations, the basic blocks may be separated into a plurality of block groups, and the movement of the sub-blocks is performed using a block group as a unit of operation. For example, in the operation of grouping the basic blocks, this embodiment may vertically separate each of the basic blocks 310', 320', 330' and 340' by a first spacing, or horizontally separate each of the basic blocks 310', 320', 330' and 340' by a second spacing, so as to form the plurality of block groups on each of the basic blocks 310', 320', 330' and 340'.

In real application, the first spacing and the second spacing may be respectively controlled by a third set value and a fourth set value pre-stored in a memory, according to the polarity of a display panel. As shown in Table 3, in this embodiment, the third set value and the fourth set value are respectively set as 1. In addition, the first spacing and the second spacing are respectively twice as big as the third set value and the fourth set value, i.e. the first spacing and the second spacing disclosed in this embodiment are both equal to 2. In other words, in each of the basic blocks 310', 320', 330' and 340', each 2 rows of the sub-blocks in horizontal or vertical directions will be grouped as a block group, and the other situations can be inferred from this case.

TABLE 3

| | |
|---|---|
| Third Set Value | 01 |
| Fourth Set Value | 01 |

For example, the block group 354 is a block group formed by vertically separating the basic block 310' by the first spacing, and the block group 352 is a block group formed by horizontally separating the basic block 310'. In addition, in this embodiment, the rotating operations for forming the second extended blocks include up/down swapping, left/right swapping, and both up/down and left/right swapping.

For example, in the rotating operation of up/down swapping, the block groups from separation by the second spacing will be the basis for swapping an upper row and a lower row of the sub-blocks in each block group, one by one. For example, in the example of the basic block 310', the block group 362 in the second extended blocks 312 may be formed by swapping an upper row and a lower row of the sub-blocks in the block group 352; in the same way, the other block groups in the second extended blocks 312 are generated. Similarly, the second extended blocks 322, 332 and 342 may be formed from the basic blocks 310', 320' and 330' in the same way.

On the other hand, in the rotating operation of left/right swapping, the block groups from separation by the first spacing will be the basis for swapping a left row and a right row of the sub-blocks in each block group, one by one. For example, in the example of the basic block 310', the block group 364 in the second extended blocks 314 may be formed by swapping a left row and a right row of the sub-blocks in the block group 354; in the same way, the other block groups in the second extended blocks 314 are generated. Similarly, the second extended blocks 324, 334 and 344 may be formed from the basic blocks 310', 320' and 330' in the same way.

Moreover, in the rotating operation of both up/down and left/right swapping, the block groups from horizontal separation are the basis for swapping the sub-blocks in each block group one by one, and then the block groups from vertical separation are the basis for swapping the sub-blocks in each block group one by one. For example, in the basic block 310', after the operation of horizontal swapping, the arrangement manner of the sub-blocks therein will be as shown in the second extended blocks 312. Afterwards, the arrangement manner of the second extended blocks 312 will be the basis for the operation of left/right swapping, so as to form the second extended blocks 316. For example, the block group 366 is a block group formed by horizontally separating the basic block 312 by the second spacing. Here, the block group 376 in the second extended blocks 316 will be formed by swapping the left row and the right row of the sub-blocks in the block group 366. Similarly, the second extended blocks 326, 336 and 346 may be formed from the basic blocks 310', 320' and 330' in the same way.

It is to be noted that, as in the first conversion procedure, in the second conversion procedure, the described way of expanding the number of the basic blocks is only one of the embodiments of the present invention. In real application, all of the algorithms for expanding the number of basic blocks are included in the second conversion procedure. The designer may change the way of expanding the number of basic blocks based on their design needs, and the present invention is not limited thereto.

By the second conversion procedure, 4 basic blocks 310', 320', 330' and 340 with a size of 16×16 may be expanded into the 12 basic blocks 312, 314, 316, 322, 324, 326, 332, 334, 336, 342, 344 and 346 with a size of 16×16, and the number of the basic blocks is expanded into 16. In addition, as shown in FIG. 1, after expanding the number of the basic blocks by the second conversion procedure, the process will go back to step S112. Here, since the number of the basic blocks is equal to 16, i.e. the number of the basic blocks is equal to N, as shown in step S104, the expanded basic blocks will be further used to generate the dither carry tables through the timing controller, wherein the way that the carry tables record the expanded basic blocks is similar to the way that the basic tables record the basic blocks.

For example, the basic block 310' may be used to generate a dither carry table as shown in Table 4, and since the size of the basic block has been expanded to 16×16 sub-blocks, the generated dither carry table comprises 16 data rows, each data row recording 16-bit carry data. In addition, when a sub-block in the basic block 310' is black, the corresponding bit value in the carry data will be 1; otherwise, when a sub-block in the basic block 310' is white, the corresponding bit value in the carry data will be 0. Moreover, in real application, when a bit value in a carry table is 1, the dithering process will carry the corresponding pixel gray value in the pixel blocks; otherwise, when a bit value in a carry table is 0, the dithering process will not carry the corresponding pixel gray value in the pixel blocks.

TABLE 4

| Value | | | | | | | | | | | | | | | |
|---|---|---|---|---|---|---|---|---|---|---|---|---|---|---|---|
| 1 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 1 | 0 | 0 |
| 0 | 0 | 1 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 1 |
| 0 | 0 | 0 | 0 | 0 | 0 | 1 | 0 | 0 | 0 | 0 | 0 | 0 | 0 | 0 | 0 |
| 0 | 0 | 0 | 0 | 0 | 0 | 0 | 0 | 0 | 0 | 0 | 1 | 0 | 0 | 0 | 0 |
| 0 | 0 | 0 | 0 | 1 | 0 | 0 | 0 | 0 | 0 | 0 | 0 | 0 | 0 | 0 | 0 |
| 0 | 0 | 0 | 0 | 0 | 0 | 0 | 0 | 0 | 1 | 0 | 0 | 0 | 0 | 0 | 0 |
| 0 | 0 | 0 | 0 | 0 | 0 | 0 | 0 | 0 | 0 | 0 | 0 | 0 | 0 | 1 | 0 |
| 0 | 0 | 0 | 1 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 1 | 0 | 0 | 0 |
| 0 | 1 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 1 | 0 | 0 | 0 | 0 | 0 | 0 | 0 |
| 0 | 0 | 0 | 0 | 0 | 1 | 0 | 0 | 0 | 0 | 0 | 0 | 0 | 0 | 0 | 0 |
| 0 | 0 | 0 | 0 | 0 | 0 | 0 | 0 | 0 | 0 | 1 | 0 | 0 | 0 | 0 | 0 |
| 0 | 0 | 0 | 0 | 0 | 0 | 0 | 1 | 0 | 0 | 0 | 0 | 0 | 0 | 0 | 0 |

Figure 4:
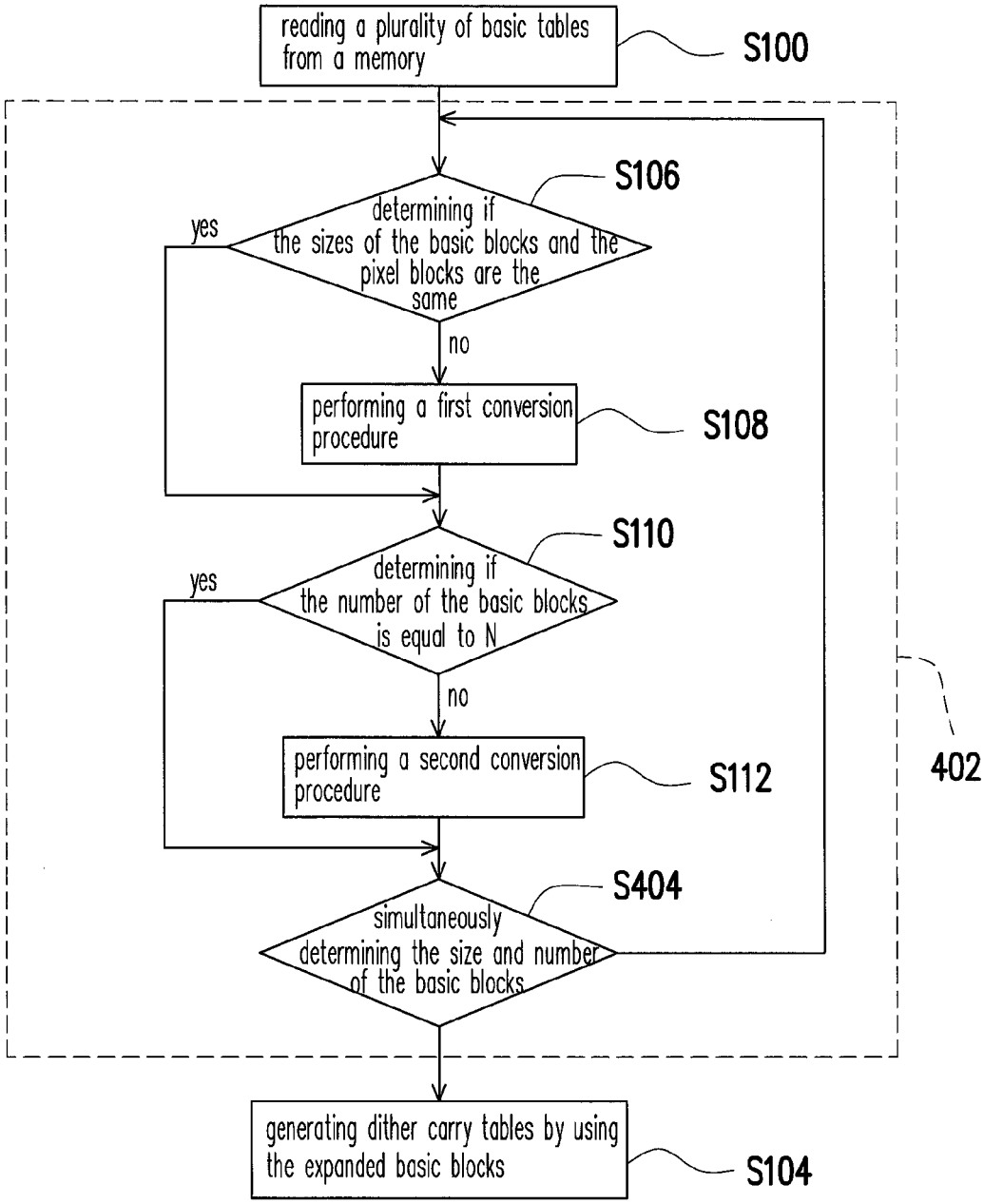
FIG. 4 is a flowchart of a carry table generating method according to another embodiment of the present invention.

From another point of view, FIG. 4 is a flowchart of a carry table generating method according to another embodiment of the present invention. Referring to FIG. 4, in this embodiment, steps S100-S112 are all the same as the embodiment of FIG. 1, and thus the explanation therefore is omitted. The main difference between this embodiment and the embodiment of FIG. 1 lies in that in the step of expanding the size and number of the basic blocks using the first conversion procedure and the second conversion procedure (step S402), no matter if the size of the expanded basic blocks meets the determination requirement through the first conversion procedure, the determination of the number of the basic blocks will be performed. By contrast, in the embodiment of FIG. 1, the first conversion procedure will be repeatedly performed until the size of the expanded basic blocks meets the determination requirement, and then the determination of the number of the basic blocks will be performed. Moreover, in this embodiment, it is simultaneously determined if the size and number of the basic blocks both meet the determination requirements, after the size and number of the basic blocks are determined in sequence (step S404). In addition, only when the size and number of the basic blocks both meet the determination requirements, the corresponding dither carry tables may be generated according to the expanded basic blocks (step S104).

Specifically, when the sizes of the basic blocks and the pixel blocks are determined to be not the same (step S106), the step of determining if the number of the basic blocks is equal to N (step S110) will be directly performed after the first conversion procedure is completed (step S108). Moreover, when the number of the basic blocks is not equal to N, the size and number of the basic blocks will be simultaneously determined (step S404) after the second conversion procedure is completed (step S112). When a result of the step of simultaneously determining the size and number of the basic blocks shows that the sizes of the basic blocks and the pixel blocks are not the same or the number of the basic blocks is not equal to N, the process will go back to the step of determining if the sizes of the basic blocks and the pixel blocks are the same (step S106).

Specifically, in this embodiment, after the step of determining if the sizes of the basic blocks and the pixel blocks are the same (step S106), when the sizes of the basic blocks and the pixel blocks are not the same, the first conversion procedure will be performed (step S108), so as to expand the size of the basic blocks. Then, no matter if the sizes of the expanded basic blocks and the pixel blocks are the same, the step of determining if the number of the basic blocks is equal to N will be performed (step S110); when the number of the basic blocks is not equal to N, the second conversion procedure (step S112) will be performed.

Moreover, after the second conversion procedure is completed, step S404 will be performed, i.e. simultaneously determining if the sizes of the basic blocks and the pixel blocks are the same, and if the number of the basic blocks is equal to N. Only when the sizes of the basic blocks and the pixel blocks are the same and the number of the basic blocks is equal to N, the step of generating the dither carry tables will be performed (step S104); otherwise the process will go back to the step of determining if the sizes of the basic blocks and the pixel blocks are the same (step S106). In other words, in this embodiment, the preset basic blocks will be expanded in size and number alternately until they are expanded into N basic blocks with a size of N×N, and the dither carry tables can be generated thereby.

It is to be noted here that the order of the steps of determining the size and number of the basic blocks in the embodiments of FIG. 1 and FIG. 4 may vary depending on the needs of the designer. In other words, in the flows of the embodiments of the present invention, there is no specific order of the events of determining if the size and number of the basic blocks meet the requirements and thereby performing the first conversion procedure and the second conversion procedure. Though in these embodiments, the step of determining if the sizes of the basic blocks and the pixel blocks are the same is always performed first, the step of determining if the number of the basic blocks is equal to N (16 in the embodiments) may also be performed first, too. The present invention is not limited thereto.

To sum up, the carry table generating method disclosed by the embodiments of the present invention, on the basis of a plurality of basic tables stored in a memory and their corresponding basic blocks, expands the size and number of the basic blocks by different conversion procedures, and further generates a plurality of corresponding dither carry tables by using the expanded basic blocks. Since the dither carry tables are formed from the a plurality of basic blocks, there is no need to store all of the dither carry tables in the memory, but only to store the basic blocks in the memory. In this way, memory consumption may be reduced significantly, and production cost may further be decreased.

Though the present invention has been disclosed above by the embodiments, they are not intended to limit the present invention. It will be apparent to one of ordinary skill in the art that modifications and variations to the described embodiments may be made without departing from the spirit and scope of the present invention. Therefore, the protecting range of the present invention falls in the appended claims.

What is claimed is:

1. A carry table generating method of a display device for generating N dither carry tables, so as to dither N pixel blocks, wherein the display device comprises a timing controller and a memory, and a size of the pixel block is N×N, N is an integer greater than 1, the carry table generating method comprising:

reading a plurality of basic tables from the memory by the timing controller, wherein the basic tables are corresponding to a plurality of basic blocks, the number of the basic blocks is smaller than N, and the size of the basic blocks is smaller than the size of the pixel blocks;

executing a first conversion procedure by the timing controller for expanding the size of the basic tables, wherein the step of expanding the size of the basic tables by the first conversion procedure comprises:

in the first conversion procedure, expanding the size of the basic blocks by using a combination among the basic blocks or a combination among the basic blocks and a plurality of first extended blocks;

executing a second conversion procedure by the timing controller for expanding the number of the basic blocks, wherein the step of expanding the number of the basic blocks by the second conversion procedure comprises:

in the second conversion procedure, re-arranging sub-blocks in the basic blocks to form a plurality of second extended blocks; and expanding the number of the basic blocks by using the second extended blocks; and generating the dither carry tables by using the expanded basic blocks through the timing controller.

2. The carry table generating method of the display device as claimed in claim 1, further comprising:

determining if the sizes of the basic blocks and the pixel blocks are the same;

determining if the number of the basic blocks is equal to N, when the sizes of the basic blocks and the pixel blocks are the same;

expanding the size of the basic blocks by the first conversion procedure and returning to the step of determining if the number of the basic blocks is equal to N, when the sizes of the basic blocks and the pixel blocks are not the same;

expanding the number of the basic blocks by the second conversion procedure and simultaneously determining the size and number of the basic blocks, when the number of the basic blocks is not equal to N;

returning to the step of determining if the sizes of the basic blocks and the pixel blocks are the same, when a result of the step of simultaneously determining the size and number of the basic blocks shows that the sizes of the basic blocks and the pixel blocks are not the same or the number of the basic blocks is not equal to N;

generating the dither carry tables by using the expanded basic blocks, when a result of the step of simultaneously determining the size and number of the basic blocks shows that the sizes of the basic blocks and the pixel blocks are the same and the number of the basic blocks is equal to N.

3. The carry table generating method of the display device as claimed in claim 1, further comprising:

determining if the number of the basic blocks is equal to N;

determining if the sizes of the basic blocks and the pixel blocks are the same, when the number of the basic blocks is equal to N;

expanding the number of the basic blocks by the second conversion procedure and returning to the step of determining if the sizes of the basic blocks and the pixel blocks are the same, when the number of the basic blocks is not equal to N;

expanding the size of the basic blocks by the first conversion procedure and simultaneously determining the size and number of the basic blocks;

returning to the step of determining if the number of the basic blocks is equal to N, when a result of the step of simultaneously determining the size and number of the basic blocks shows that the sizes of the basic blocks and the pixel blocks are not the same or the number of the basic blocks is not equal to N; and generating the dither carry tables by using the expanded basic blocks, when a result of the step of simultaneously determining the size and number of the basic blocks shows that the sizes of the basic blocks and the pixel blocks are the same and the number of the basic blocks is equal to N.

4. The carry table generating method of the display device as claimed in claim 1, further comprising:

determining if the sizes of the basic blocks and the pixel blocks are the same;

expanding the size of the basic blocks by the first conversion procedure and returning to the step of determining if the sizes of the basic blocks and the pixel blocks are the same, when the sizes of the basic blocks and the pixel blocks are not the same;

determining if the number of the basic blocks is equal to N, when the sizes of the basic blocks and the pixel blocks are the same;

expanding the number of the basic blocks by the second conversion procedure and returning to the step of determining if the number of the basic blocks is equal to N, when the number of the basic blocks is not equal to N; and generating the dither carry tables by using the expanded basic blocks, when the number of the basic blocks is equal to N.

5. The carry table generating method of the display device as claimed in claim 1, further comprising:

determining if the number of the basic blocks is equal to N;

expanding the number of the basic blocks by the second conversion procedure and returning to the step of determining if the number of the basic blocks is equal to N, when the number of the basic blocks is not equal to N;

determining if the sizes of the basic blocks and the pixel blocks are the same, when the number of the basic blocks is equal to N;

expanding the size of the basic blocks by the first conversion procedure and returning to the step of determining if the sizes of the basic blocks and the pixel blocks are the same, when the sizes of the basic blocks and the pixel blocks are not the same; and generating the dither carry tables by using the expanded basic blocks, when the sizes of the basic blocks and the pixel blocks are the same.

6. The carry table generating method of the display device as claimed in claim 1, wherein the step of executing the first conversion procedure by the timing controller for expanding the size of the basic blocks further comprises:

in the first conversion procedure, re-arranging sub-blocks in the basic blocks to form the first extended blocks.

7. The carry table generating method of the display device as claimed in claim 6, wherein the step of re-arranging the sub-blocks in the basic blocks to form the first extended blocks comprises:

vertically shifting the sub-blocks in each of the basic blocks according to a first shifting quantity;

horizontally shifting the sub-blocks in each of the basic blocks according to a second shifting quantity; and forming the first extended blocks according to the shifted basic blocks.

8. The carry table generating method of the display device as claimed in claim 7, further comprising:

retrieving a first set value and a second set value from the memory; and determining the first shifting quantity and the second shifting quantity by using the first set value and the second set value.

9. The carry table generating method of the display device as claimed in claim 1, wherein the step of re-arranging the sub-blocks in the basic blocks to form the second extended blocks comprises:

selecting one of a plurality of rotating operations;

moving the sub-blocks in each of the basic blocks to form a part of the second extended blocks by using the selected rotating operation; and repeating the step of selecting one of the rotating operations and the step of moving the sub-blocks in each of the basic blocks until each of the rotating operations is selected one by one.

* * * * *